US005358311A

United States Patent [19]

Drumm

[11] Patent Number: 5,358,311

[45] Date of Patent: Oct. 25, 1994

[54] STRIP BRUSH FOR MOUNTING ON A ROTARY DRUM

[76] Inventor: Arthur E. Drumm, 14808 Hillview Rd., Marysville, Ohio 43040

[21] Appl. No.: 132,099

[22] Filed: Oct. 5, 1993

Related U.S. Application Data

[60] Division of Ser. No. 958,799, Oct. 9, 1992, Pat. No. 5,251,355, which is a continuation-in-part of Ser. No. 777,905, Oct. 17, 1991, Pat. No. 5,160,187.

[51] Int. Cl.[5] ..... A46D 3/00

[52] U.S. Cl. ..... 300/21

[58] Field of Search ..... 300/21; 15/179, 182, 15/183

[56] References Cited

U.S. PATENT DOCUMENTS

| | | | |
|---|---|---|---|
| 2,136,103 | 11/1938 | Herold | 300/21 |
| 2,303,386 | 12/1942 | Peterson | 300/21 X |
| 2,511,004 | 6/1950 | Peterson | 300/21 X |
| 2,757,400 | 8/1956 | Peterson | 300/21 X |
| 2,767,418 | 10/1956 | Lombardi | 15/183 |
| 2,778,047 | 1/1957 | Nielsen | 300/21 X |
| 2,778,048 | 1/1957 | Nielsen | 300/21 X |
| 2,921,329 | 1/1960 | Peterson | 15/183 X |
| 2,978,726 | 4/1961 | Park | 15/183 |
| 3,002,212 | 10/1961 | Tilgner | 300/21 X |
| 3,241,172 | 3/1966 | Tilgner . | |
| 3,715,773 | 2/1973 | Drumm | 15/183 |
| 3,862,462 | 1/1975 | Reiter . | |
| 4,142,267 | 3/1979 | Clark . | |
| 4,490,877 | 1/1985 | Drumm | 15/182 |
| 4,498,210 | 2/1985 | Drumm | 15/183 |
| 4,955,102 | 9/1990 | Cousins | 15/183 X |
| 5,045,091 | 9/1991 | Abrahamson et al. . | |
| 5,160,187 | 11/1992 | Drumm . | |

FOREIGN PATENT DOCUMENTS

| | | | |
|---|---|---|---|
| 82431 | 11/1956 | Denmark | 15/183 |
| 1093323 | 11/1960 | Fed. Rep. of Germany | 15/183 |
| 2218914 | 10/1973 | Fed. Rep. of Germany | 15/183 |
| 2707673 | 8/1978 | Fed. Rep. of Germany | 15/183 |
| 710230 | 6/1954 | United Kingdom | 300/21 |
| 779845 | 7/1957 | United Kingdom | 300/21 |
| 780225 | 7/1957 | United Kingdom | 300/21 |
| 790826 | 2/1958 | United Kingdom | 15/183 |

*Primary Examiner*—Timothy V. Eley
*Assistant Examiner*—Frances Han
*Attorney, Agent, or Firm*—Sidney W. Millard

[57] ABSTRACT

A bristle strip for rotary brushes comprising a supporting channel in which the closed ends of the U-shaped bristles are clamped. The channel is provided with laterally-extending guide members mounted directly thereon that project laterally outwardly beyond its side flanges to guide the strip when it is inserted in a guide track on a rotary drum and to retain it therein. Due to the simple nature of the strip it can be produced at a low cost without special tooling.

7 Claims, 7 Drawing Sheets

FIG. 1
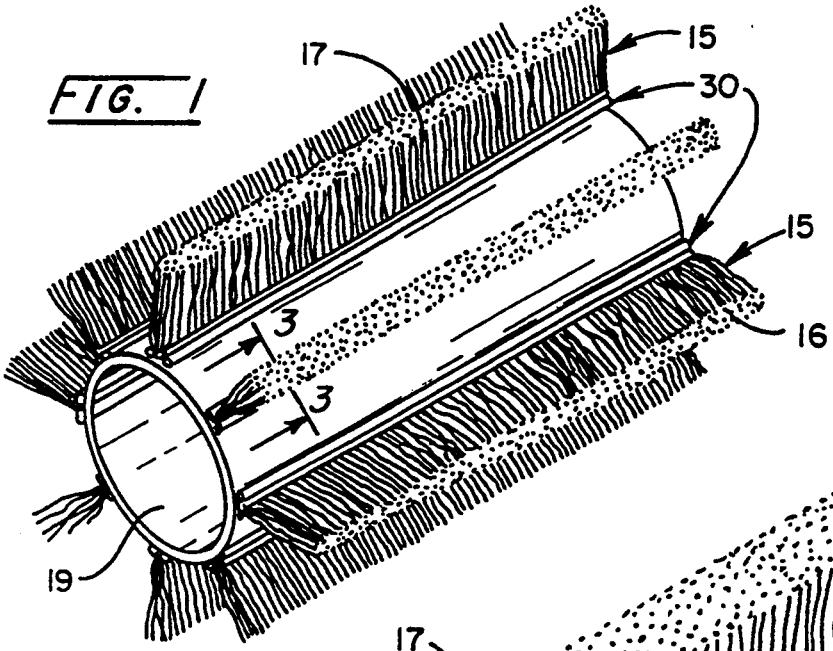
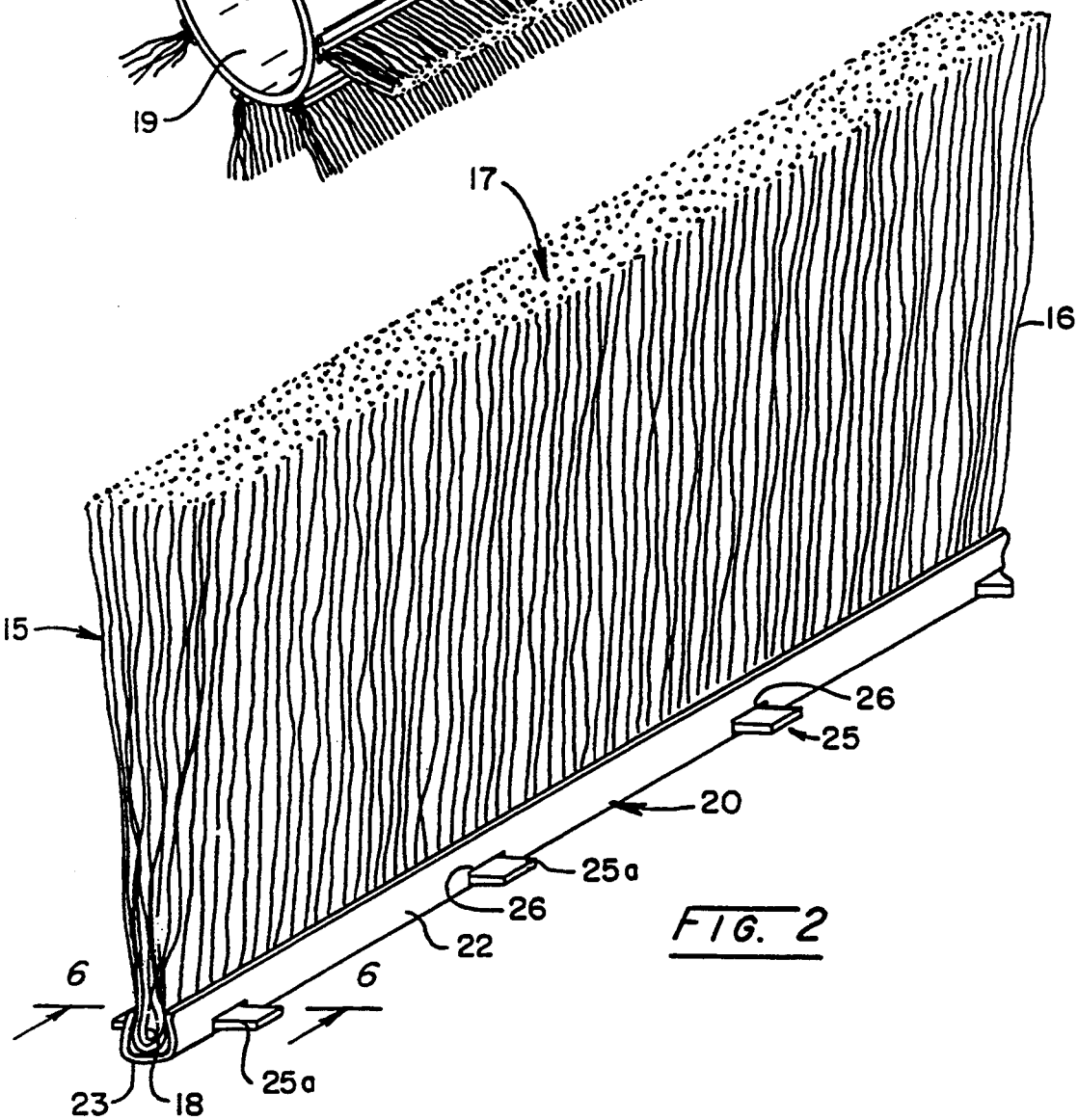
FIG. 2

FIG. 17
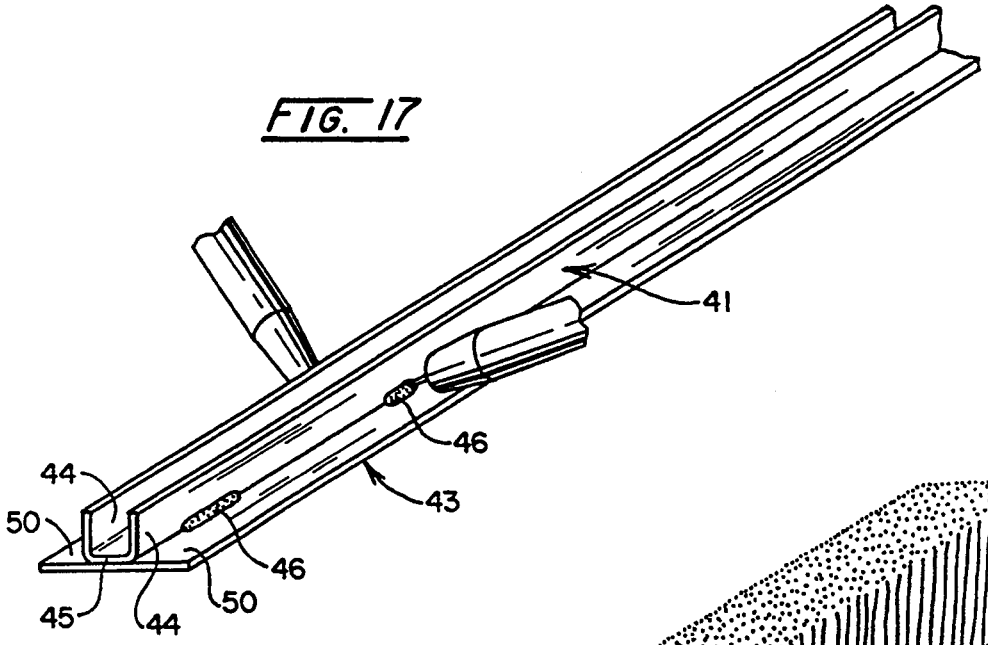
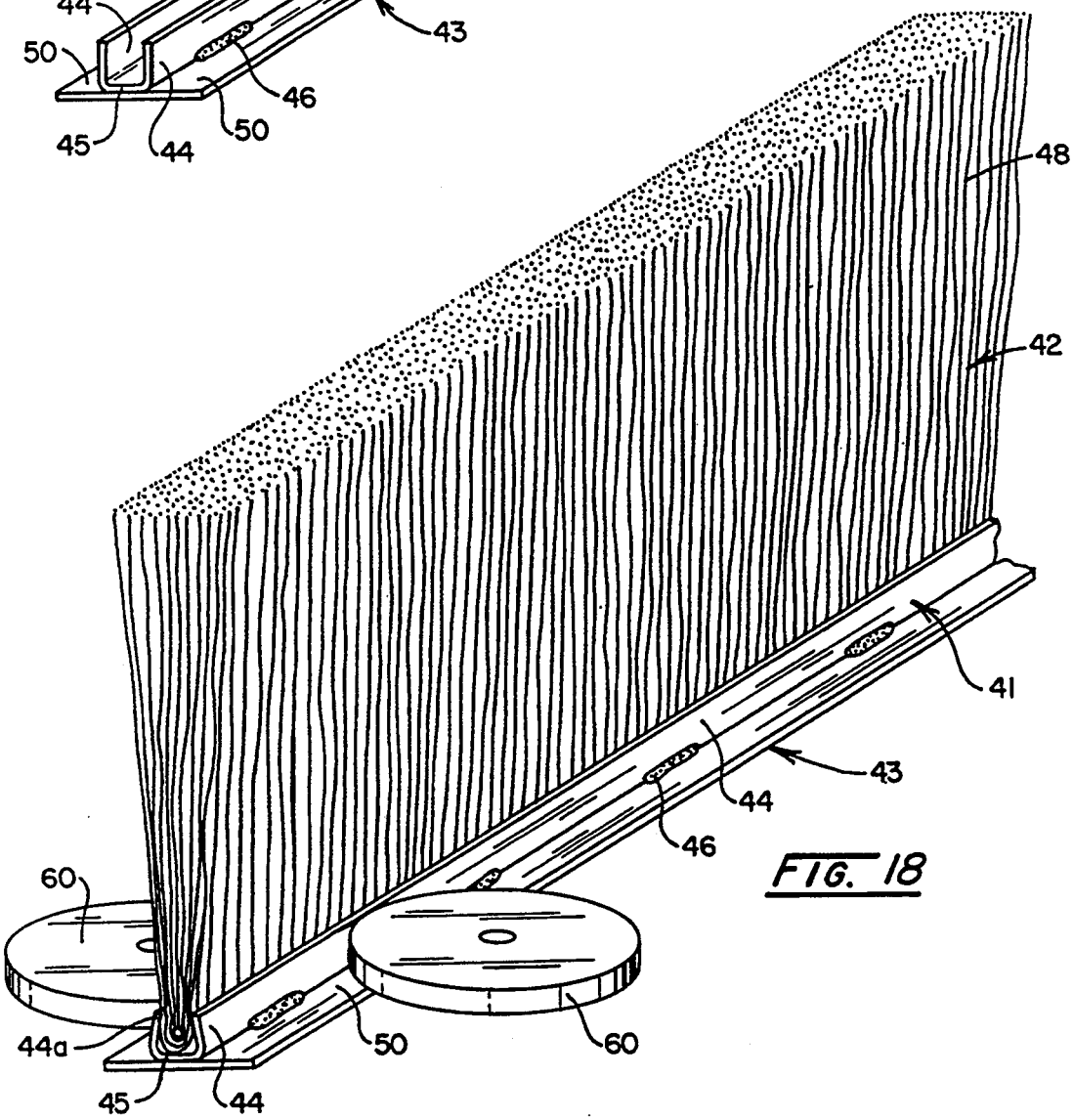
FIG. 18

STRIP BRUSH FOR MOUNTING ON A ROTARY DRUM

This application is a divisional application of co-pending application Ser. No. 07/958,799, filed Oct. 9, 1992, now U.S. Pat. No. 5,251,355 which is a continuation-in-part of application Ser. No. 777,905, filed Oct. 17, 1991, now U.S. Pat. No. 5,160,187.

FIELD OF THE INVENTION

This invention relates to rotary brushes of the type comprising a drum upon which is mounted strips of bristles. The strips are mounted in tracks on the drum and can be removed for replacement when worn.

BACKGROUND AND PRIOR ART

Rotary brushes now commonly on the market and in use consist of a drum which carries bristle strips on its periphery. The strips are mounted in various ways on the drum and are usually removable so that they can be replaced after wear. It is important that the strip be of such a nature that it can be produced with simple tooling and at a low cost of time and material.

At present a popular brush strip is produced by a slow, costly method of providing a metal strip with holes punched at longitudinally spaced intervals which are to receive the bristles. The closed ends of U-shaped bristles are bunched together and then inserted in these holes; the number of ends must be accurate so that the holes will be filled. The bristles are plastic and are retained in the holes by a heat process. This method of producing bristle strips is limited to plastic bristles and is difficult to perform and time-consuming. It also produces a weak strip that is difficult to handle, the weakness resulting from the successive holes. Due to this weakness, the strip tends to bend at longitudinal intervals from its plane and thus makes it difficult to handle in inserting it into the end of the receiving grooved track or channel on the drum. This track usually has opposed laterally spaced guide grooves for receiving laterally-extending flanges on the bristle strip.

Another method forms a strip for sliding into a track on the drum by double-joining,, back-forming, etc. to provide an outwardly-opening, bristle-receiving channel with laterally-extending lower flanges adapted to slip in the laterally-extending grooves of the drum-mounted tracks. This method requires expensive tooling and produces a weak arrangement that results in a leverage problem during rotation of the drum tending to spring apart the flanges of the outwardly-opening bristle-receiving channel and thereby release the bristles.

Many other forms of tracks are provided on drums in the prior art to receive bristle carrying strips. This invention provides a strip which can slip in any guide track that provides laterally-opposed receiving guide grooves which extend longitudinally of the track.

The present invention provides a strip brush for mounting on a rotary drum which is of simple construction and can be removably slipped readily into tracks of the type now usually provided on rotary drums. This bristle strip can be produced without high-cost materials, and expensive tooling and time-consuming operations resulting in a low cost strip. It can be inserted readily in the drum track, will be effectively retained therein and can be removed with ease when it is necessary to replace it. The bristle strip is stronger and easier to install and remove as compared to prior art strips and as indicated above is less costly to produce.

SUMMARY OF THE INVENTION

The bristle strip of this invention is of channel form and receives a mat of bristles of U-form having a retaining wire running through the U ends of the mat bristles as in the prior art. This mat of bristles is retained in the carrying channel by crimping of the sides or flanges of the channel. The channel is provided with guide means for fitting into the drum-carried track in the form of laterally-extending guide members which project laterally outwardly beyond the upstanding flanges of the channel. These guide members will slip directly into the laterally-opposed continuous receiving guide grooves of the drum mounted track.

In one form of the invention for mounting in the drum-carried track the upstanding sides or flanges of the channel are provided with pairs of opposed slots which receive guide members in the form of lugs that project laterally from each side or flange of the outwardly extending sides or flanges of the channel. These laterally-projecting guide lugs provide guide ears which will project slidably into the laterally-opposed guide grooves of the track. This form of the bristle strip can be economically produced from a flat strip of metal which is perforated to provide the holes in the channel which is subsequently formed from the flat strip by a simple bending operation.

In another form of the invention the bristle mat-carrying channel is secured directly, such as by welding, to a guide strip which is co-extensive with the mat-carrying channel. This strip is wider than the channel and extends laterally outwardly therefrom to provide longitudinally continuous guide members in the form of continuous flanges which are adapted to slip into the laterally-opposed continuous guide grooves of the track of the drum.

BRIEF DESCRIPTION OF THE DRAWINGS

The best mode contemplated in carrying out this invention is illustrated in the accompanying drawings in which:

FIG. 1 is a perspective view of a drum having bristle strips of this invention mounted thereon in straight parallel angularly spaced relationship;

FIG. 2 is an enlarged perspective view of the bristle strip of one form of this invention;

FIG. 17 is a perspective view indicating a step in the making of this form of bristle strip before the bristle mat is inserted in the channel which will carry it;

FIG. 18 is a perspective view indicating another step in the making of the bristle strip after the bristle mat is inserted in the channel.

DETAILED DESCRIPTION OF THE INVENTION

Figure 6:
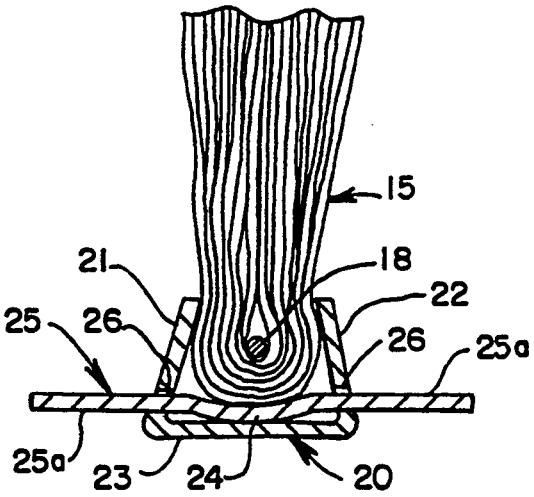
FIG. 6 is an enlarged transverse sectional view taken along line 6—6 of FIG. 2.

With reference to the drawings, the bristle strip of this invention is shown in detail in the drawings and is designated generally by the number 15. Each strip consists of the bristle receiving and carrying channel 20 into which the U-form bristles 16 of the mat of bristles designated generally at 17 are inserted. A retaining wire 18 passes longitudinally through the closed lower ends of the bristles 16 to retain them in the channel 20 which in its final form has the parallel upstanding sides or flanges 21 and 22 that are crimped into contact with the spaced sides of the bristle mat 17 outwardly of the wire 18. The mat 17 may be formed of U-shaped flexible bristles 16 which are of metal, plastic or other suitable material with their open upper ends projecting from channel 20. At longitudinally spaced intervals guide lugs 25 are passed through opposed slots 26 in the walls 21 and 22 of the channel 20 just above the bottom wall 23 of the channel. The projecting ends of the lugs 25 provide guide ears **25*a* which will extend into the opposed guide grooves of the drum-mounted tracks 30 (FIG. 1) as will be explained later. Each lug 25 is provided with a curved depression or indentation 24 midway of its length to hold it in a fixed position laterally of the channel 20 when the bristle mat 17 is inserted in that channel and is crimped into engagement with the mat (FIG. 6). This causes the curved lower ends of the bristles 16 to be forced downwardly into the curved indentations 24 to lock the lugs in fixed lateral positions as shown in FIG. 6. Each indentation 24 is formed transversely in each lug 25 to provide a transverse groove for receiving the lower curved end of the mat 17. The curved lower side of the indentation 24 forms a boss which will contact the bottom 23 of the channel 20**.

An alternative embodiment, not illustrated, may include two parallel channels 20 with their edges abutting. The lug 25 is longer than illustrated in FIG. 6 to extend through aligned slots 26 in both juxtaposed channels. The resulting strip is somewhat stiffer and the radially projecting bristles are more dense at the periphery of the brush unit.

Figure 3:
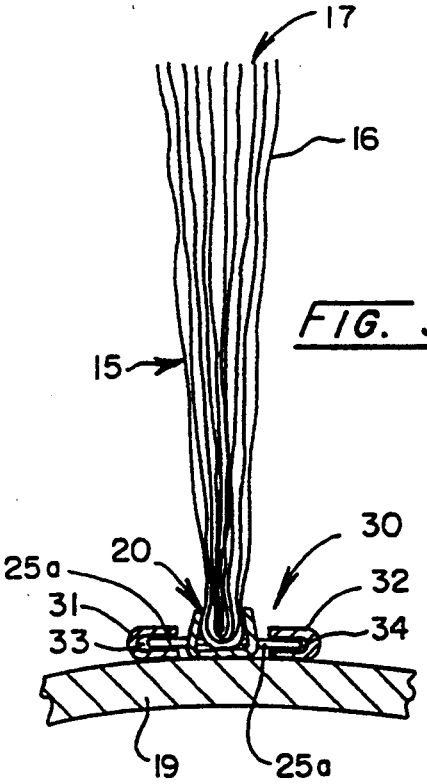
FIG. 3 is an enlarged transverse sectional view taken along line 3—3 of FIG. 1 having one type of drum track into which the bristle strip of this invention is slipped.

One form of track is indicated at 30 in FIG. 1 where several of the tracks are shown on the drum 19 in straight angularly spaced positions where they may be welded or otherwise secured to the drum as indicated in FIG. 3. The track 30 in this instance is composed of U-shaped metal sections 31 and 32 secured around the drum in parallel spaced positions to form the opposed inwardly opening guide grooves 33 and 34 which will receive the ears 25. The track sections 31 and 32 may be of metal or plastic and be secured to the drum by various means.

Figure 4:
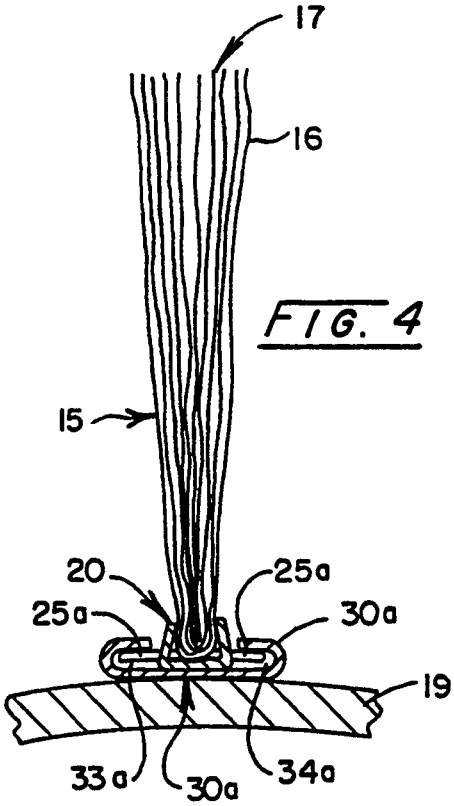
FIG. 4 is a similar view showing a different form of track with the bristle strip of this invention inserted.

FIG. 4 shows another form of track **30*a* which is shaped to provide the laterally-opposed guide grooves 33*a* and 34*a* for receiving the guide ears 25*a* of the bristle strip 20. The track is welded or otherwise secured to the drum 30**.

Figure 5:
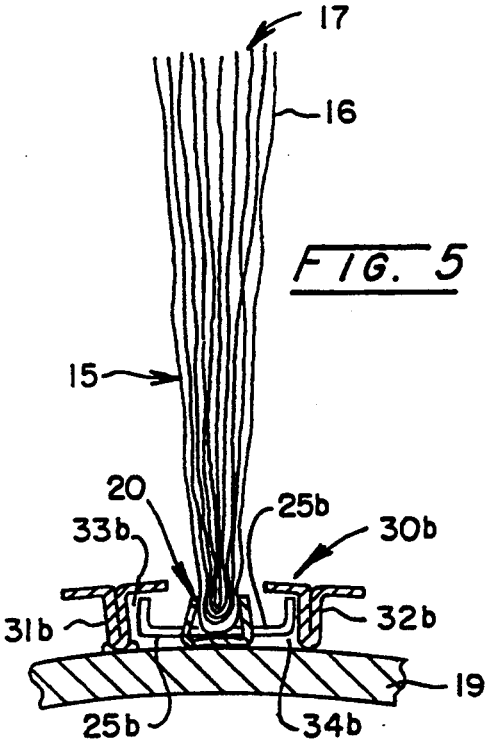
FIG. 5 is a similar view showing the bristle strip inserted into a different form of track.

In FIG. 5 a different form of prior art track **30*b* may be provided on the drum 30. This provides the guide grooves 33*a* and 34*a* by welding to the drum 30 inverted T-shaped strips 31*a* and 32*a*. In this instance the ends of the lug ears 25*b* are bent upwardly after insertion so as to fit snugly in the respective grooves 33*b* and 34*b***.

The bristle strip 15 of this invention will slide into any track on the drum or other object which has the spaced laterally-opposed guide grooves that provide a socket for receiving the channel 20 of the bristle strip 15 and the opposed inwardly-opening guide grooves which will receive the opposed guide ears extending from the strip. In each case inserting and crimping the mat 17 of bristles in the channel 20 will press the lower curved end of the bristles 16 into indentations 24 to lock the guide lugs 25 laterally in position in the channel so that guide ears **25*a*** will project.

Figure 9:
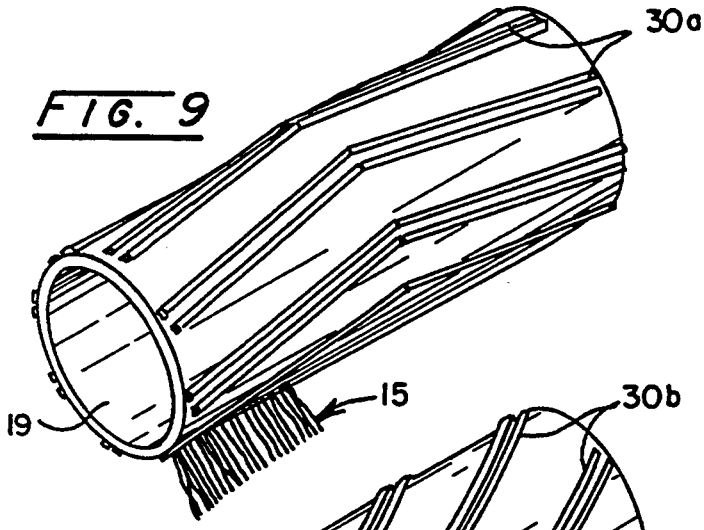
FIG. 9 shows a herringbone arrangement of the strips on a drum.
Figure 10:
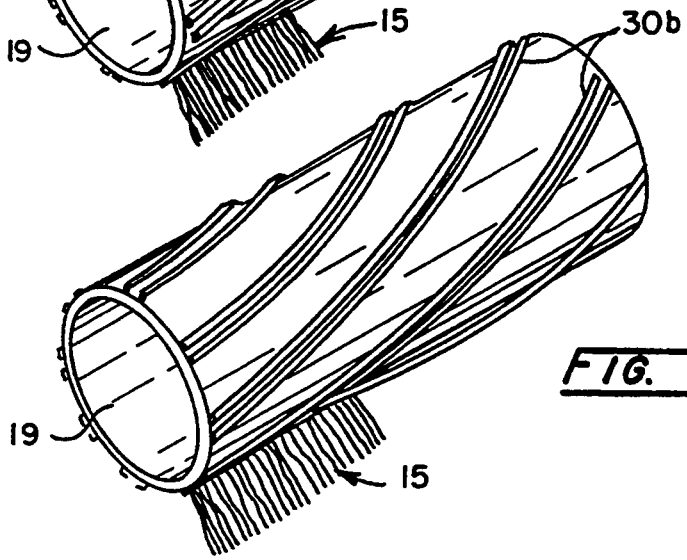
FIG. 10 shows the strips on the drum extending helically of the drum.

As indicated the bristle strips 15 may be positioned on the drum 19 in various arrangements depending upon the arrangement of the guide tracks on the drum. In FIG. 1 the strips 15 are of straight form and are inserted in the straight angularly spaced guide tracks 30. The strips will be sufficiently strong to facilitate this insertion. In FIG. 9 the tracks **30*a* are arranged on the drum in a herringbone relationship. In FIG. 10, the tracks 30*b* are arranged in a curved helical pattern on the drum 19. The strips 15 are relatively stiff to permit the straight insertion into the tracks 30 and 30*a* but are capable of being twisted about their longitudinal axes for inserting them into the curved tracks 30*b* and for bending in the herringbone pattern 30*a* of FIG. 9**.

Figure 7:
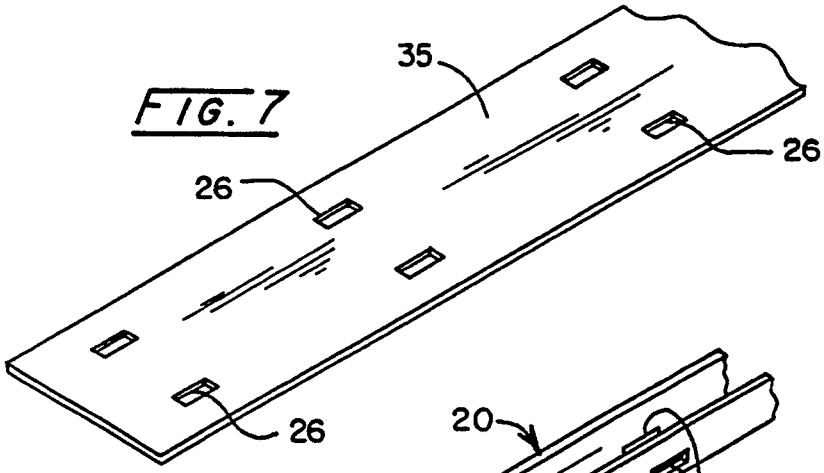
FIG. 7 shows a flat strip which can be used in forming the channel that carries the bristles.
Figure 8:
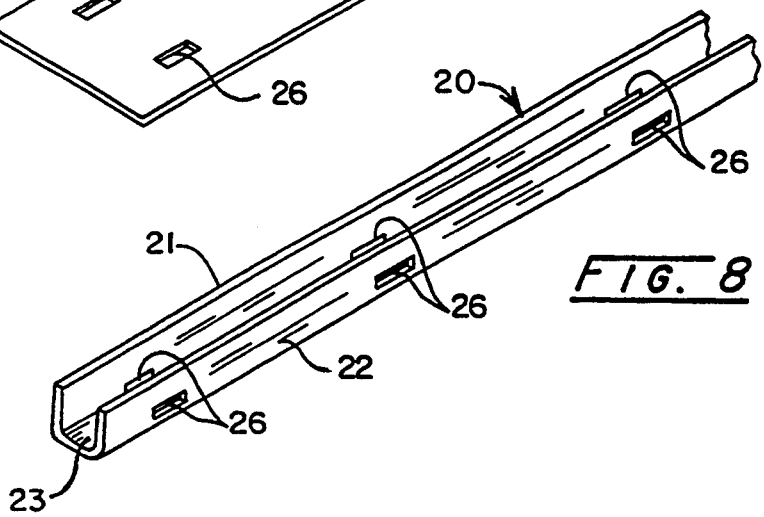
FIG. 8 shows the channel after it is formed from the flat strip.

As indicated, the bristle strip 15 is of such a nature that it can be produced by a simple low-cost method which is illustrated in FIGS. 7 and 8. It is produced from a flat elongated strip of metal 35 by a stamping or other operation which forms two parallel rows of slots 26. These slots are arranged as laterally-opposed pairs at longitudinally spaced intervals. The strip 35 is then formed into the channel 20 by forming rolls or other forming means. This positions the slots 26 of each pair directly opposite each other in the respective upstanding flanges 21 and 22 of the channel. Also, it will be noted that these slots are located just above the bottom 23 of the channel. Thus, the channel 20 with the slots 26 formed therein can be produced by a simple low-cost method which does not require expensive tooling.

It will be apparent that the bristle strip of this form of the invention is a simple structure in the form of a single channel which receives the bristle mat that is retained therein by crimping the sides of the channel. At longitudinal intervals the channel side walls are provided with slots for receiving guide lugs which project laterally and will fit into most drum tracks now in use. These lugs are held in fixed lateral position by a locking means which functions when the mat of bristles is positioned in the channel. The nature of the bristle strip permits production at a very low cost without special tools.

Figure 11:
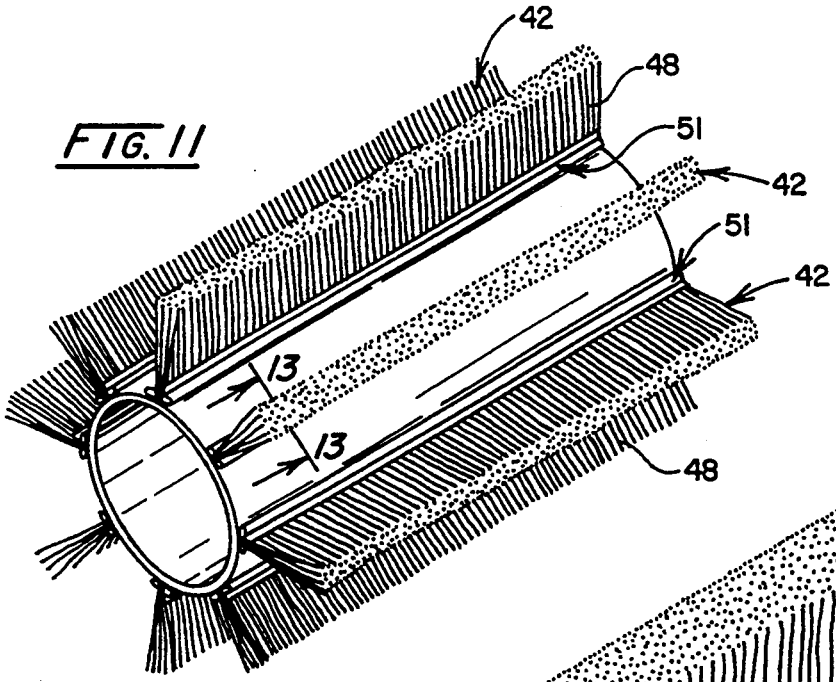
FIG. 11 is a view similar to FIG. 1 but showing another form of the bristle strip of this invention on the drum.
Figure 12:
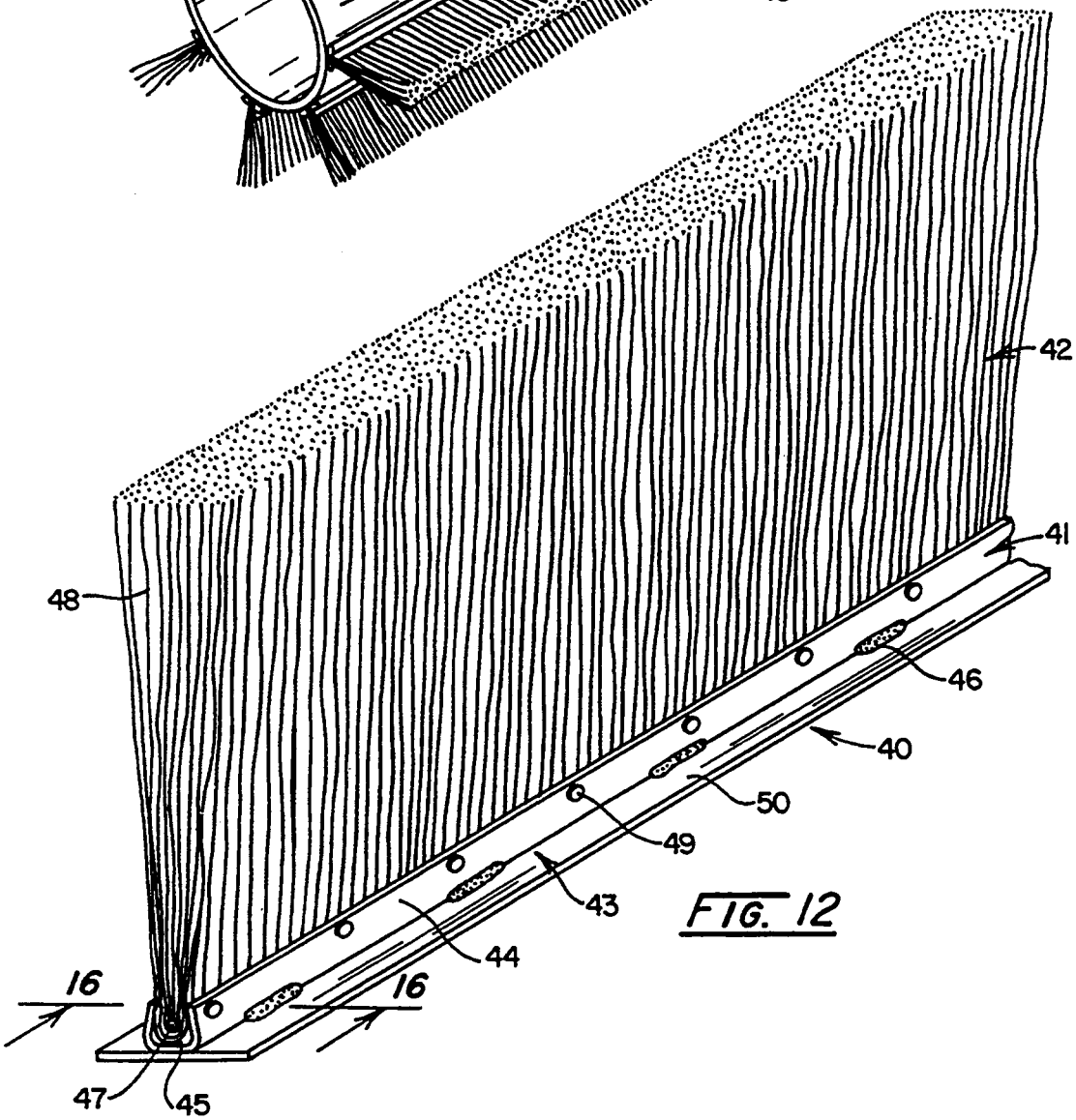
FIG. 12 is an enlarged perspective view of the bristle strip carried by the drum in FIG. 11.
Figure 14:
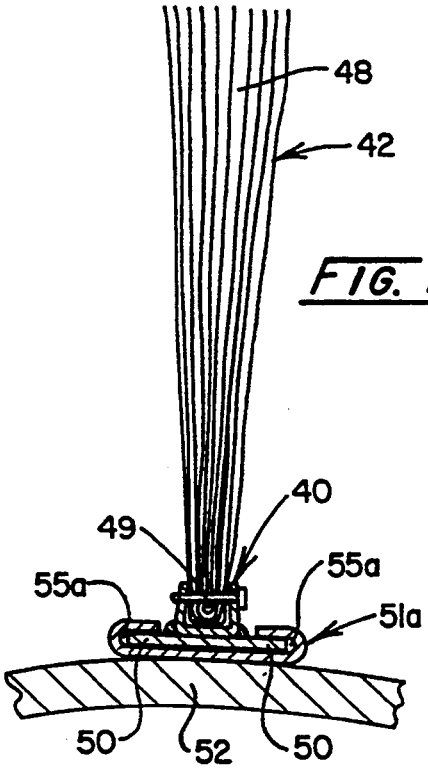
FIG. 14 is a similar view showing a different form of track with this form of the bristle strip inserted.
Figure 15:
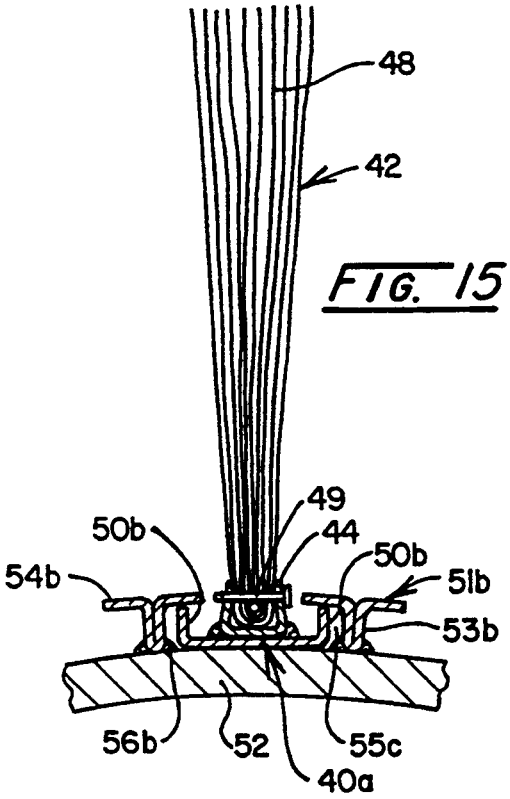
FIG. 15 is a similar view showing the bristle strip mounted into a different form of track.
Figure 16:
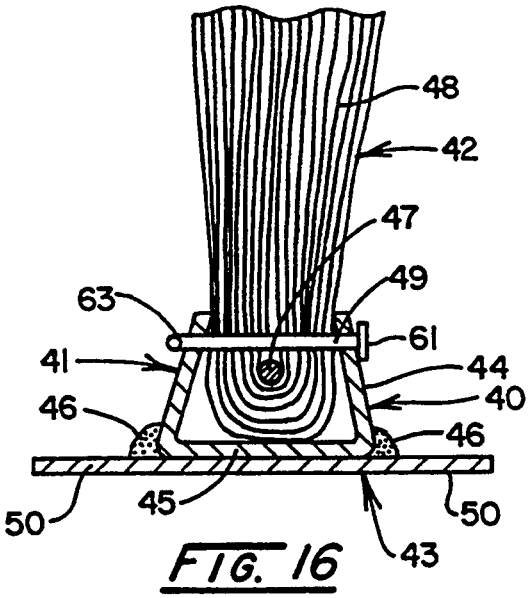
FIG. 16 is an enlarged transverse sectional view taken along line 16—16 of FIG. 12.

FIGS. 11 to 19 indicate a different form of bristle strip and method of making it according to this invention. The bristle strip is designated generally by the number 40. The completed strip as shown in FIGS. 12 and 16 consists of the bristle-receiving and carrying channel 41 that carries the mat of bristles 42 and the co-extensive guide strip 43 secured directly to the channel. The channel is of U-form with the upstanding parallel flanges 44 and the bottom 45. The channel 41 is secured to the flat guide strip 43 on which its bottom 45 rests by longitudinally spaced opposed welds 46 which are in opposite pairs. The welds are at the lower corners of the channel 41. They could be continuous. The mat of bristles 42 has a retaining wire 47 passing longitudinally through the closed ends of the U-shaped bristles 48 to retain them in the channel 41. In FIG. 12 bristle retaining members in the form of nails 49 are shown passed through the upstanding flanges 44 and through the upstanding bristles of the mat 42 above the retaining wire 47 to aid in holding the bristles of the mat in the channel 41. The guide strip 43 thus provides laterally-opposed guide members which are co-extensive with the channel 41 carried thereby and which extend in opposite directions laterally beyond the upstanding flanges 44 of the channel which is centered on the strip. These guide members are in the form of guide flanges 50 which are adapted to slip directly in the laterally-opposed guide grooves of a drum mounted track.

Figure 13:
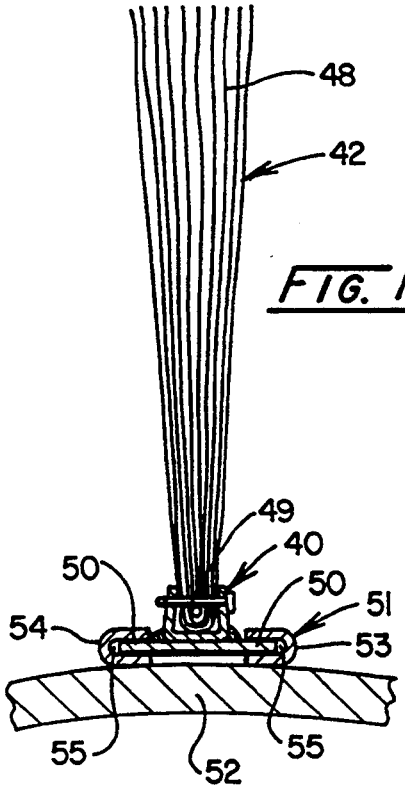
FIG. 13 is an enlarged transverse sectional view taken along line 13—13 of FIG. 11 showing one type of drum track into which this form of the bristle strip is slipped.

One form of track for receiving a bristle strip is indicated in FIG. 13 and is designated generally by the numeral 51. A series of these tracks are shown mounted on a drum 52 in straight angularly spaced positions where they may be welded or otherwise secured to the drum as shown in FIG. 11. The track 51 in this instance is composed of U-shaped metal sections 53 and 54 secured around the drum in parallel spaced positions to form the opposed inwardly opening guide grooves 55 and 56 which will receive the strip guide flanges 50 as the strip is mounted in the drum as shown in FIG. 13.

FIG. 14 shows another form of track **51*a* which is shaped to provide the laterally-opposed guide grooves 55*a* and 56*a* for receiving the guide flanges 50 of the bristle strip 40. The track 51*a*** is welded or otherwise secured to the drum.

In FIG. 15 a different form of track **51*b* may be provided on the drum 52 for receiving the slightly modified bristle strip 40*a*. The guide grooves 55*a* and 56*a* are provided by welding to the drum inverted T-shaped strips 53*b* and 54*b* to provide the laterally-opposed grooves 55*b* and 56*b*. In this instance the edges of the guide strip 43*b* will be bent upwardly so that the strip is of channel form and includes upstanding guide lips 50*b*. The strip 43*b* preferably has the upstanding guide lips 50*b* formed thereon before it is welded to the channel 41 that later receives the bristle mat 42**.

Figure 19:
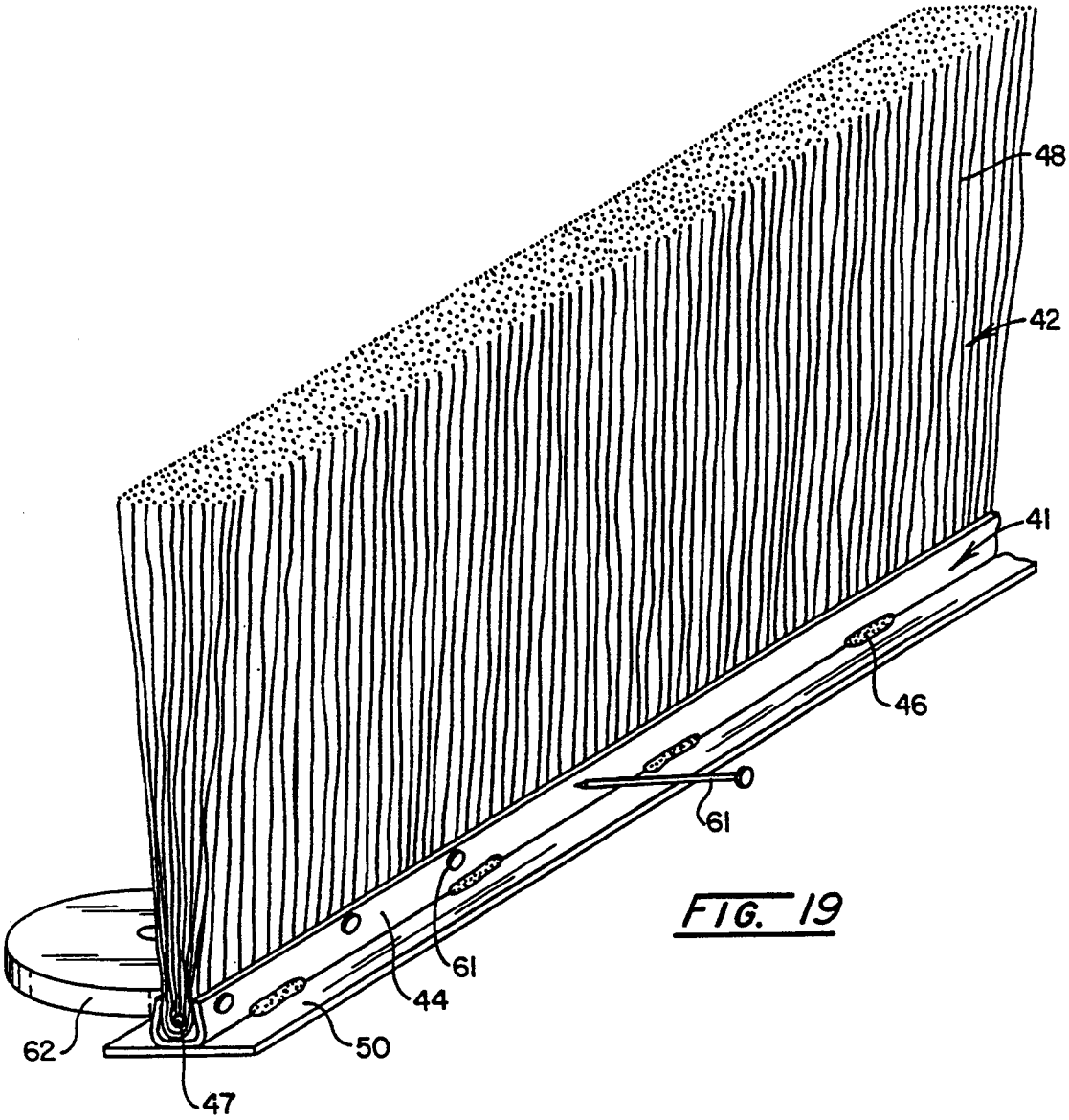
FIG. 19 is a similar perspective view showing the final step of the method.

This form of the bristle strip **40–40*b* is of such a nature that it also can be produced by a simple low cost method. This method is illustrated in FIGS. 17, 18 and 19. In FIG. 17 there is shown the guide strip 43 with the longitudinally co-extensive bristle mat receiving channel 41 welded thereto by the welds 46 located at the lower corners of the upstanding channel flanges 44. The bottom 45 of the channel is in flat contact with the upper surface of the guide strip 43 as shown. The upstanding flanges 44 are spaced apart to receive the lower end of the bristle mat 42**.

The next steps of the method are illustrated in FIG. 18. The mat 42 with the wire 47 positioned therein is then positioned in the channel 41 by inserting its lower edge, having the closed ends of the bristles 48, resting on the flat bottom 45 of the channel and between the upstanding flanges 44 thereof. The upstanding flanges 44 are then crimped inwardly by crimping rollers 60 which engage the upstanding flanges 44 at opposite sides. This holds the mat 42 firmly in the channel 41 that is attached to the upper surface of strip 43 by welds 46 as previously described. Welding before inserting the mat 42 of bristles is especially important if the bristles are of plastic so they will not be melted. However, the mat 42 could be inserted in and crimped in the channel 41 and then the channel could be welded to the guide strip 43. It will be noted from FIGS. 16 and 18 that the crimped flanges 44 engage the mat at their upper edges **44*a* above the wire 47 as shown in FIGS. 16 and 18. Thus, this form of the invention provides a brush strip which consists of only three main elements, the bristle mat 42, the mat receiving channel 41 and the guide strip 43, the latter two being secured together by the welds 46. The bristle strip 40 can be slipped readily into the end of any drum track which provides laterally-opposed grooves for receiving the guide flanges 50 which prevent radial outward movement during rotation of the drum 52. The bristle mat 42 will be secured in the channel 41 during this rotation by the crimped sides 44 of the channel 41**.

Instead of crimping the sides 44 of the channel 41 as described, they may be crimped as shown in FIG. 5 of U.S. Pat. No. 4,498,210.

For rough usage, such as sweeping brick streets, it may be desirable to use the arrangement illustrated in FIG. 19. This comprises the use of mat retaining nails 61 which are passed transversely through the flanges 44 of the channel 41 and through the bristle mat 42 by means of a suitable nail gun. These nails are shot through the assembly above the mat wire 47 as indicated in FIG. 16 with their pointed ends projecting beyond the opposite flanges 44 and are subsequently bent over against the adjacent flange 44 by a roller 62, the bent ends being shown at 63 in FIG. 16 in engagement with the adjacent flange while the heads thereof engage the opposite flange. The nails may be disposed at suitably longitudinally spaced intervals. The nails 61 passing through the flanges 44 and the mat 42 above the wire 47 (FIG. 16) will firmly hold the mat in the channel 41.

The bristle strip 40 may be positioned in tracks on the drum in various arrangements such as those shown in FIGS. 9 and 11.

It will be apparent from the above description that the bristle strip of this invention is a simple structure which can be produced by a simple low cost method which does not require expensive tooling. The bristle strip assembly comprises a supporting channel having spaced upstanding flanges in which the bristle mat is clamped and track-guide and retaining means carried by the channel in the form of laterally-extending guide and retaining members which project laterally outwardly beyond the upstanding flanges of the channel and are adapted to be slipped into laterally-opposed grooves in a drum track.

Although the bristle strip of this invention was intended for use mainly on rotary drums, it could be used for other applications.

I claim:

1. A method of producing a bristle strip which comprises providing an elongated support channel of U-form with upstanding side flanges and a bottom, providing a guide strip which has an upper surface upon which the bottom of the channel is rested, welding the channel longitudinally along its length to said surface, and providing a mat of U-shaped bristles having a closed lower end and an open upper end and positioning said mat between said upstanding flanges with the bottom end of said mat above the bottom of said channel, and clamping the mat in said channel by crimping said flanges together to engage said mat.

2. A method according to claim 1 in which the welding takes place after insertion and crimping of the mat in the channel.

3. The method of claim 1 wherein the welding takes place before insertion and crimping of the mat in the channel.

4. A method according to claim 1 in which the mat is provided with a retaining wire extending longitudinally through the bristles thereof at the closed end of said mat, and the engagement of the crimped flanges of the support channel is above said wire.

5. A method according to claim 4 in which the channel is positioned on said surface of the guide strip intermediate its edges to provide the oppositely projecting guide flanges.

6. A method according to claim 5 in which headed nails each having a pointed end are passed through both said upstanding side flanges of the support channel and through the lower end of said mat with the heads in engagement with one of said upstanding flanges and the pointed ends projecting through the other flange and bent back into engagement with said other flange.

7. The method of claim 6 in which a guide track is provided on a drum and has opposed guide receiving grooves and positioning the opposed guide flanges of said strip in said grooves.

* * * * *